US007597601B2

(12) United States Patent
Mravca

(10) Patent No.: US 7,597,601 B2
(45) Date of Patent: Oct. 6, 2009

(54) RESISTANCE KICKBOARD

(76) Inventor: David J. Mravca, 809 Piper Ave., Sunnyvale, CA (US) 94087

( * ) Notice: Subject to any disclaimer, the term of this patent is extended or adjusted under 35 U.S.C. 154(b) by 19 days.

(21) Appl. No.: 11/136,174

(22) Filed: May 23, 2005

(65) Prior Publication Data

US 2006/0003647 A1 Jan. 5, 2006

Related U.S. Application Data

(60) Provisional application No. 60/578,369, filed on Jun. 9, 2004, provisional application No. 60/603,782, filed on Aug. 23, 2004.

(51) Int. Cl.
*B63B 1/00* (2006.01)

(52) U.S. Cl. ..... 441/65; 482/55; 482/111; 441/129

(58) Field of Classification Search ..... 482/55, 482/111; 441/65, 129, 315; 222/175; 114/315; 272/175; 434/254
See application file for complete search history.

(56) References Cited

U.S. PATENT DOCUMENTS 3,261,318 A * 7/1966 Jones et al. ..... 114/245
3,517,930 A * 6/1970 Jacobsen ..... 482/55
3,945,068 A 3/1976 Carbonero
4,362,518 A 12/1982 Boissiere
4,406,628 A * 9/1983 Rademacher ..... 434/254
4,781,638 A 11/1988 Winters, Jr.
5,518,429 A 5/1996 Gravlin
5,558,551 A * 9/1996 Irby ..... 441/65
5,573,487 A * 11/1996 Wallner ..... 482/124
5,634,834 A 6/1997 Cole
5,755,368 A * 5/1998 Bekkedahl ..... 224/414
6,083,067 A 7/2000 McCredie
6,135,837 A * 10/2000 Giles ..... 441/79
6,142,843 A * 11/2000 Haase ..... 441/129
6,257,944 B1 * 7/2001 Herrod ..... 441/130
6,840,831 B2 1/2005 Katz
6,872,111 B2 3/2005 Katz
6,955,577 B1 10/2005 Hall
7,044,818 B2 5/2006 Askins
7,101,344 B1 9/2006 Wu

* cited by examiner

*Primary Examiner*—Ed Swinehart
(74) *Attorney, Agent, or Firm*—Lesavich High-Tech Law Group, P.C.; Stephen Lesavich

(57) ABSTRACT

A resistance kickboard. The resistance kickboard includes plural resistance indicia that provide varying levels of resistance when the resistance kickboard is moved through water. The varying levels resistance allow swimmers, exercisers and rehabilitation patients to spend less time in a pool while obtaining additional training, exercising or rehabilitation effects. The resistance kickboard may also include a reservoir to hold a liquid. The liquid allows a user to stay hydrated while using the resistance kickboard for longer periods without stopping the activity.

16 Claims, 9 Drawing Sheets

RESISTANCE KICKBOARD

CROSS REFERENCES TO RELATED APPLICATIONS

This application claims priority to U.S. Provisional Patent Application Nos. 60/578,369, filed Jun. 9, 2004, and 60/603,782, filed Aug. 23, 2004, the contents of both of which are incorporated by reference.

FIELD OF INVENTION

This invention relates to kickboards. More specifically, it relates to a resistance kickboard.

BACKGROUND OF THE INVENTION

A number of devices have been developed to assist swimmers in learning how to swim, improving the swimming ability of experienced swimmers and to provide aids for water based exercise programs for fitness and rehabilitation after injury. Kickboards are one such device. The kickboard is typically made from a material which will float and helps support a swimmer, water exerciser or rehab patient in the water.

The use of kickboards is particularly helpful to swimmers engaged in competitive swimming. In competitive swimming, there are various leg kicking techniques associated with different swimming strokes. Kickboards are used to help an experienced swimmer develop a stronger leg kick for swimming competitions.

However, there are several problems associated with kickboard known in the art. One problem is that competitive swimmers typically spend many hours training in a pool. One primary use of a kickboard is to provide resistance to a swimmer, in order to strengthen the swimmer's legs while maintaining good body position. However, most kickboards do not provide much resistance for a swimmer. Most kickboards known in the art are smooth on both sides and do not provide much drag in the water.

Another problem as a swimmer's ability improves, more resistance is needed, otherwise has the swimmer must spend more time in the pool to obtain the same training effects using the kickboard. However, most kickboards know in the art do not provide additional or configurable resistance as a swimmer's ability improves. The same is true for exercisers and rehab patients.

Another problem is that swimmers, exercisers and rehab patients currently have to stop from time to time to drink water to stay hydrated and avoid dehydration. This disrupts swimming training, exercising and rehab activities. Runners and athletes in other sports drink while exercising. However, drinking is difficult in the swimming pool while training, exercising or rehabbing.

The have been attempts to solve some of the problems associated with kickboards. For example, U.S. Pat. No. 6,872,111, entitled "Kickboard," that issued to Katz, et al. teaches "a kickboard comprising a relatively thin, buoyant board no longer than twenty six inches. The board has a back edge and a front edge joined by side edges. The board also has top and bottom surfaces joined by the front, back and side edges. Two, spaced-apart, forearm receiving depressions are provided in the top surface of the board, the depressions extending forwardly from the back edge of the board over a major portion of the length of the board to near the front edge. The depressions help to retain the forearms of a swimmer using the board on the board. The kickboard has hand grips located in front of the forearm receiving depressions. Preferably, at least the front portions of the side edges are bent toward each other, and the hand grips are located on the bent front portions, preferably just in front of, and aligned with, the forearm receiving depressions. Gripping the bent front portions allows the wrists to remain in a normal position relative to the forearms thus reducing stress."

U.S. Pat. No. 6,840,831, entitled "Kickboard," that issued to Katz et al., teaches "a kickboard having a rigid base of generally thin, rectangular, shape. At least one shallow cutout or depression is formed in the top surface of the base, the depression extending rearwardly from near the front edge of the base and being at least wide enough and long enough to receive a swimmer's arm when the swimmer grips the front edge of the base with his hand. A layer of cushioning material can be provided in the depression to cushion the arm of the swimmer while gripping the board by the front edge. The front edge of the board is rounded and at least partly cushioned as well. A groove is provided in the bottom surface of the base positioned to receive the finger-tips of the swimmer while gripping the front edge. A second groove can be provided in the top surface of the base, just behind the finger-tip groove, for receiving a portion of the palm of the swimmer's hand while gripping the front edge."

U.S. Pat. No. 5,634,834, entitled "Ergonomic kickboard," that issued to Cole et al. teaches "kickboard made of an elongate board having a top surface and a bottom surface, wherein the board has front, rear, and side edges that border the top and bottom surfaces. The bottom surface of the board is substantially convex in shape within the front and side edges. The board has a pair of elongate channels of defined depth formed in the bottom surface. The channels extend longitudinally from the rear edge toward the front edge and taper in depth near the front edge. The channels provide a variety of comfortable, ergonomically designed hand grip positions and also provide stability to the kickboard."

U.S. Pat. No. 5,518,429, entitled "Kickboard," that issued to Gravlin teaches "a kickboard for a swimmer which has a rigid, smoothly contoured, buoyant body symmetrical about a longitudinally extending notional plane perpendicular to its top surface and passing through a center thereof. When referenced to the kickboard being supported by a flat horizontal support surface, the top surface is inclined rearwardly, along the intersection with the notional plane, from a front peripheral edge and upwardly from the support surface reaching a maximum and then curving downwardly toward the sides and in a rearwardly direction. A central curvilinear opening extends from proximal the maximum with opening peripheral side edges extending rearwardly, spaced away from respective outer peripheral side edges of the body so as to provide contoured elongated arm receptacles. A bottom surface of the body follows a similar profile as the overlying top surface."

U.S. Pat. No. 4,781,638, entitled "Kickboard for swimmers," that issued to Winters teaches "a variable drag and buoyancy kickboard for a swimmer comprising a first portion, a second portion, and a plurality of pairs of hand grasping locations. The second portion extends from a lateral edge of the first portion. The first portion defines a first planar surface and the second portion defines a second planar surface. The first and second planar surfaces form an obtuse angle. The first and second portions having a periphery upon which the hand grasping locations are disposed. Each pair of hand grasping locations are laterally opposite each other on the periphery. Grasping different pairs of hand grasping locations varies the flow characteristics of the kickboard by varying its position in the water. Thus, the drag of the kickboard may be varied."

U.S. Pat. No. 4,362,518, entitled "Combined kick board and arm stroke swimming practice device," that issued to Boissiere teaches "the practice device has convexly rounded streamlined sides which flank a flat thinner center portion to provide hollows at each face which generally conform to the insides of the thighs of the user and is held between the thighs during arm stroke practice. During leg kick practice the sides of the device are held by the hands of the swimmer for use as a "kick board". Hand hold recesses can be provided on the sides to facilitate gripping during kick-board use, and the sides of the hollows can diverge to better conform to the configuration of the insides of the thighs."

U.S. Pat. No. 3,945,068, entitled "Swimmer's Aid," that issued to Carbonero teaches "the swimmer's aid is a generally S-shaped board having means on the upper surface thereof for engagement with the hands of a swimmer. The swimmer holds the board in front of him with his arms extended and propels himself by means of kicking his legs. The rearward end of the board is downturned to act as a drag. The forward end of the board is upturned to minimize any tendency of the board to dive into the water during use. The swimmer's aid is a practice device intended to assist in improving a swimmer's ability."

However, none of these solutions solve all of the problems associated with kickboards. Thus, it is desirable to provide a kickboard for swimmers, exercisers and rehaber with resistance. It is also desirable to provide a resistance kickboard that allows a user to stay hydrated without leaving stopping use of the resistance kickboard.

SUMMARY OF THE INVENTION

In accordance with preferred embodiments of the present invention, some of the problems associated with kickboards overcome. A resistance kickboard is presented.

The resistance kickboard includes plural resistance indicia that provide varying levels of resistance when the resistance kickboard is moved through water. Indicia and resistance indicia are defined to be components, entities, formations, objects, pieces, sections, or surfaces that provide varying levels of resistance when the resistance kickboard is moved through the water. The resistance kickboard may also include a reservoir to hold a liquid. The liquid allows a user to stay hydrated while using the resistance kickboard.

The foregoing and other features and advantages of preferred embodiments of the present invention will be more readily apparent from the following detailed description. The detailed description proceeds with references to the accompanying drawings.

BRIEF DESCRIPTION OF THE DRAWINGS

Preferred embodiments of the present invention are described with reference to the following drawings, wherein.

DETAILED DESCRIPTION OF THE INVENTION

Figure 1:
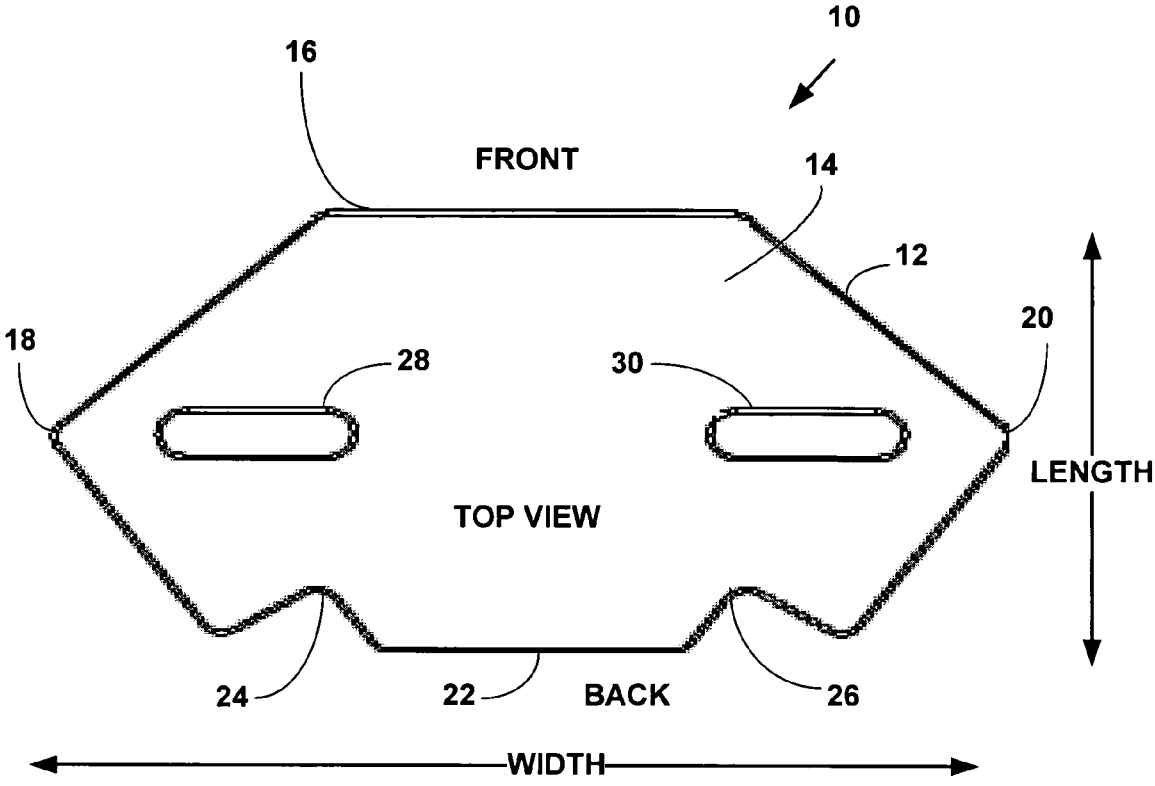
FIG. 1 is a block diagram illustrating a top view of a resistance kickboard.

FIG. 1 is a block diagram illustrating a top view 10 of a resistance kickboard. The resistance kickboard includes a rigid buoyant body 12 with a smooth top portion 14 with a straight front side 16, an angular left side 18, an angular right side 20 and an angular back side 22.

The smooth top portion 14 includes a first angular gripping location 24 and a second angular gripping location 26 to allow a user to grasp the resistance kickboard. The first angular gripping location 24 and the second angular gripping location 26 are included on the angular back side 22. The resistance kickboard also includes a first contoured gripping location 28 and a second contoured location 30 also used for holding the resistance kickboard.

In one embodiment, the rigid buoyant body 12 comprises Ethylene Vinyl Acetate (EVA) foam or closed cell EVA foam. In another embodiment, the rigid buoyant body 12 comprises an elastomer. As is known in the art, an elastomer is type of polymer that exhibits rubber-like qualities. However, the present invention is not limited to these materials and other rigid buoyant materials, such as wood, plastic, rubber, composite materials, etc. can be used to practice the invention.

In one embodiment, the rigid buoyant body 12 includes a pre-determined width-to-length ratio in which a width of at least two times a pre-determined length is used. In this embodiment, a width of at least two times a pre-determined length that allows the resistance kickboard to provide resistance while allowing arms of a user to be placed in a comfortable position. A wider width-than-length provides stability in water, resistance and comfort to the user. However, the present invention is not limited to this embodiment, and other width-to-length ratios can also be used to practice the invention.

In another embodiment of the invention, the resistance kickboard includes a length-to-width ratio in which a length of at least two times a pre-determined width is used. However, the present invention is not limited to this embodiment, and other length-to-width ratios can also be used to practice the invention.

Figure 2:
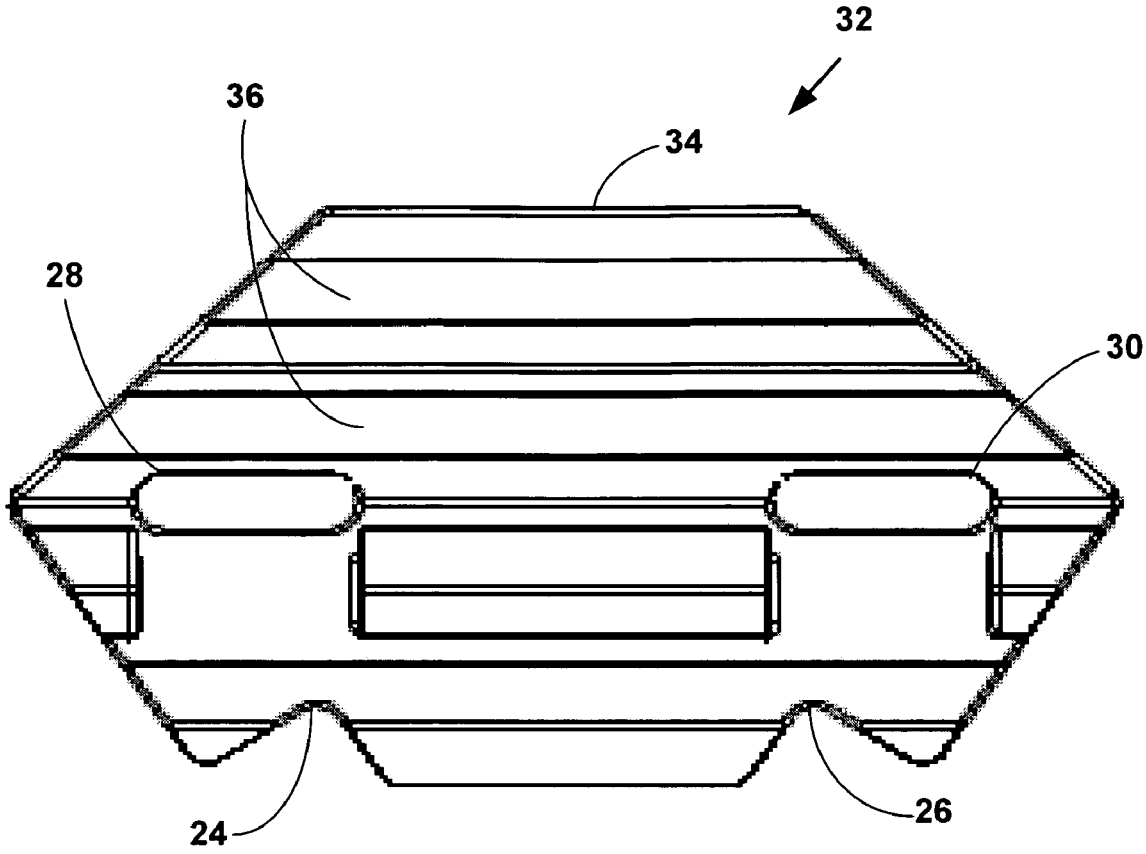
FIG. 2 is a block diagram illustrating a bottom view of the resistance kickboard.

FIG. 2 is a block diagram illustrating a bottom view 32 of the resistance kickboard. The resistance kickboard includes a bottom non-smooth side 34 of the rigid buoyant body 12 with plural resistance indicia 36 that provide resistance when the rigid buoyant body 12 is moved through water.

In one embodiment, the plural resistance indicia 36 include plural equal spaced angular indicia each attached to the bottom non-smooth side 34 at a same pre-determined angle. In one embodiment the pre-determined angle includes a pre-determined angle between forty-five (45) degrees and one-hundred thirty-five (135) degrees. However, the present invention is not limited to this embodiment, and other pre-determined angles can be used to practice the invention.

In one embodiment, the angle of the plural resistance indicia is varied to provide varying levels of resistance in the water. For example, a first lowest level of resistance may correspond to an angle of forty-five degrees. A last highest level of resistance may correspond to an angle of one-hundred thirty-five degrees, or visa-versa. Other levels of resistance used to attach the plural resistance indicia are used to provide other levels of resistance. The varying levels of resistance allow swimmers, exercisers and rehab patients to vary resistance levels and to increase resistance levels to higher resistance levels and fitness and strength improves.

In another embodiment, the plural resistance indicia 36 include plural non-equally spaced angular indicia each attached to the bottom non-smooth side 34 at a same predetermined angle. In another embodiment, the plural resistance indicia 36 include plural non-equally spaced angular indicia each attached to the bottom non-smooth side 34 at different or varying angles. In another embodiment, the plural resistance indicia 36 include plural non-angular indicia (e.g., rounded 47 (FIG. 8B) or other resistance indicia).

In one embodiment, the rigid buoyant body 12 includes plural different colors. A selected color indicates a resistance level for the plural resistance indicia 36 that provide a selected resistance when the rigid buoyant body 12 is moved through water. For example, the rigid buoyant body 12 may include a green color for a lowest resistance level, a yellow color for a next resistance level, a red color for a next resistance level, and a black color for a highest resistance level. However, the present invention is not limited to these specific colors, and more, fewer or other colors can also be used to practice the invention. The plural different colors allow a desired resistance level to be easily and quickly determined, while selecting a resistance kickboard for use.

In one embodiment the plural resistance indicia 36 are permanently attached to the rigid buoyant body 12. In another embodiment the plural resistance indicia 36 are removable and dynamically adjustable to varying angles providing varying levels of resistance. In such an embodiment the plural resistance indicia 36 each include plural attachment means that attach to plural attachment receptacles (e.g., holes, etc.) in varying locations on the bottom non-smooth side 34 of the rigid buoyant body 12 to provide adjustable varying levels of resistance.

Figure 3:
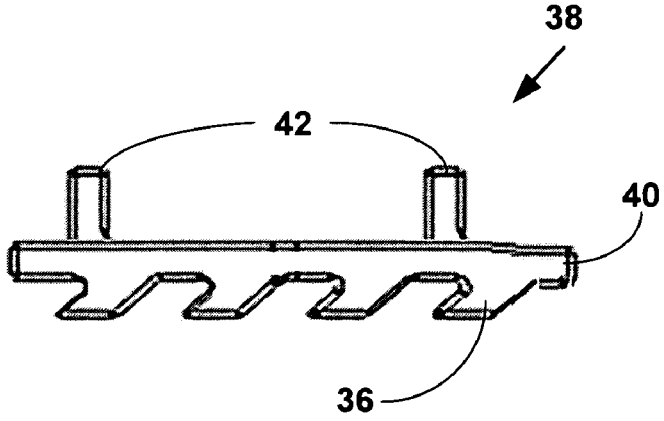
FIG. 3 is a block diagram illustrating a side view of one removable resistance indicia.

FIG. 3 is a block diagram illustrating a side view 38 of one removable resistance indicia 40. In this exemplary embodiment, the removable resistance indicia 40 includes plural attachment portions (e.g., pegs, etc.) 42 that attach to plural attachment receptacles 49 (FIG. 8B) in one set of plural locations on the bottom non-smooth side 34 of the rigid buoyant body 12 to provide adjustable varying levels of resistance.

For example, a first removable resistance indicia 40 could be added to the rigid buoyant body 12 for a first level of resistance. A second removable resistance indicia 40 could then be added to the rigid buoyant body 12 to provide a second higher level of resistance. Additional removable resistance indicia 40 can be added until all the plural attachment receptacles are filed with resistance indicia 40 at which a maximum level of possible resistance is reached. Similarly, selected ones of the removable resistance indicia 40 can be added for removed to provide detachable and adjustable and varying levels of resistance.

Figure 4:
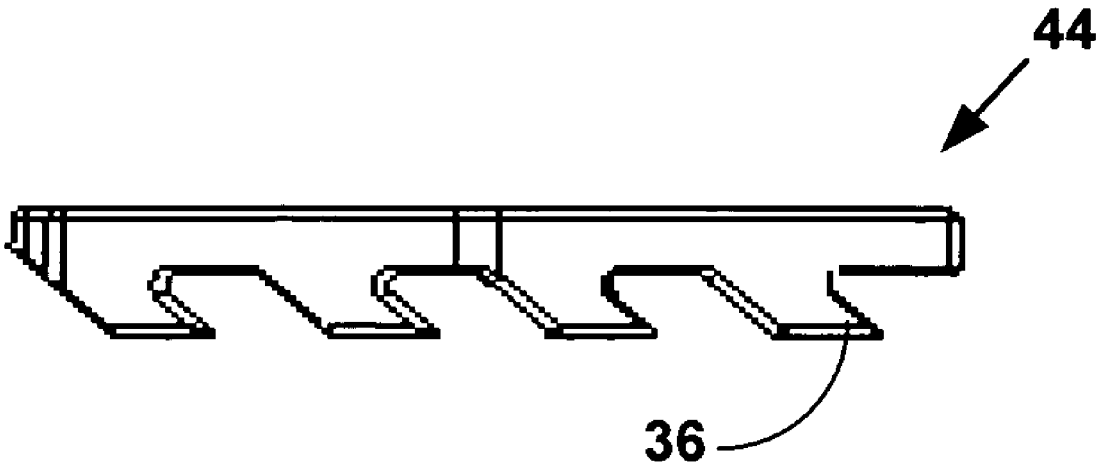
FIG. 4 is a block diagram illustrating a side view of the angular left side the resistance kickboard.

FIG. 4 is a block diagram illustrating a side view 44 of the angular left side 18 the resistance kickboard.

Figure 5:
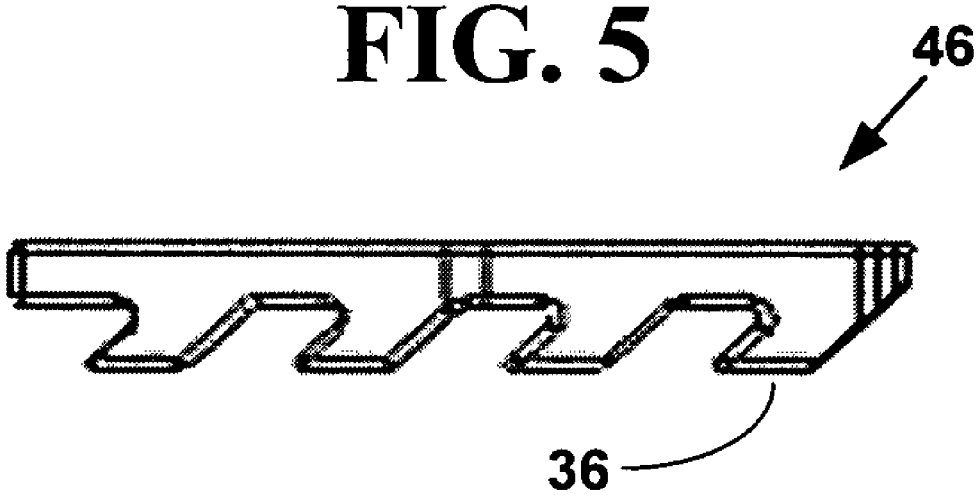
FIG. 5 is a block diagram illustrating a side view of the angular right side the resistance kickboard.

FIG. 5 is a block diagram illustrating a side view 46 of the angular right side 20 the resistance kickboard.

Figure 6:
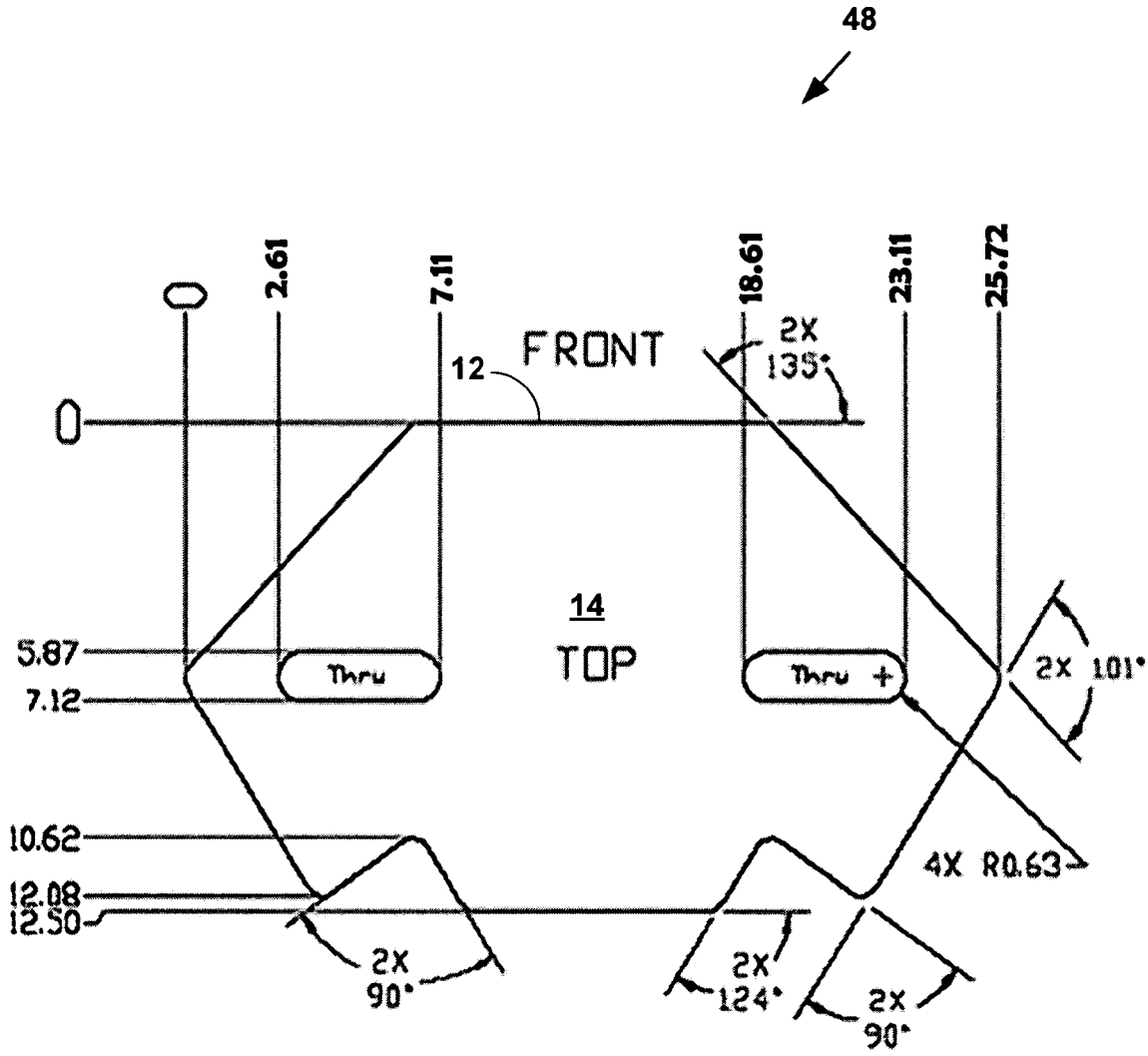
FIG. 6 is a block diagram illustrating a top view of the resistance kickboard with exemplary measurements and angles for one exemplary embodiment.

FIG. 6 is a block diagram illustrating a top view 48 of the resistance kickboard with exemplary measurements and angles for one exemplary embodiment.

Figure 7:
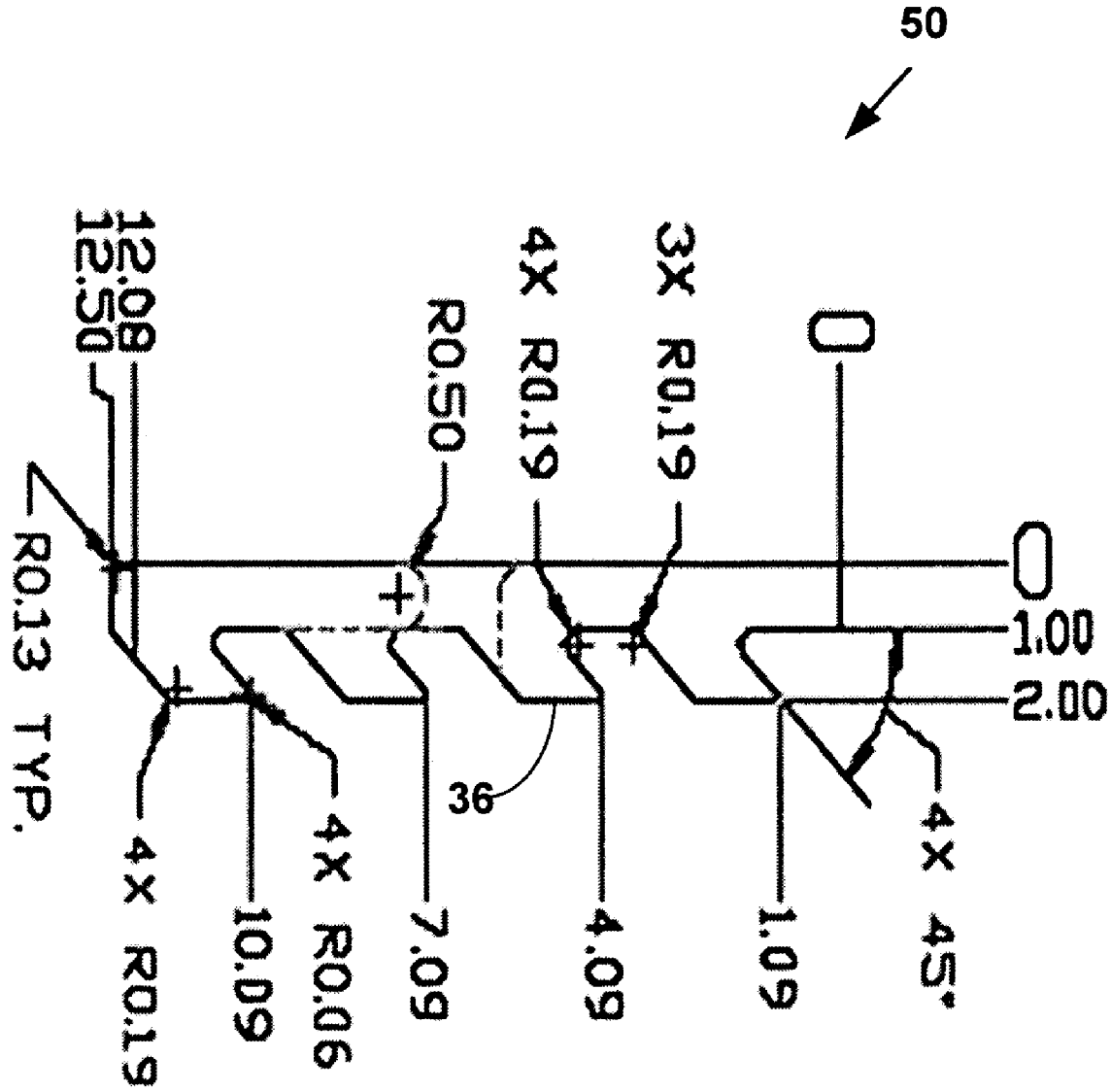
FIG. 7 is a block diagram illustrating a side view of the angular left side the resistance kickboard with exemplary measurements and angles for one exemplary embodiment.

FIG. 7 is a block diagram illustrating a side view 50 of the angular left side 18 the resistance kickboard with exemplary measurements and angles for one exemplary embodiment.

Figure 8:
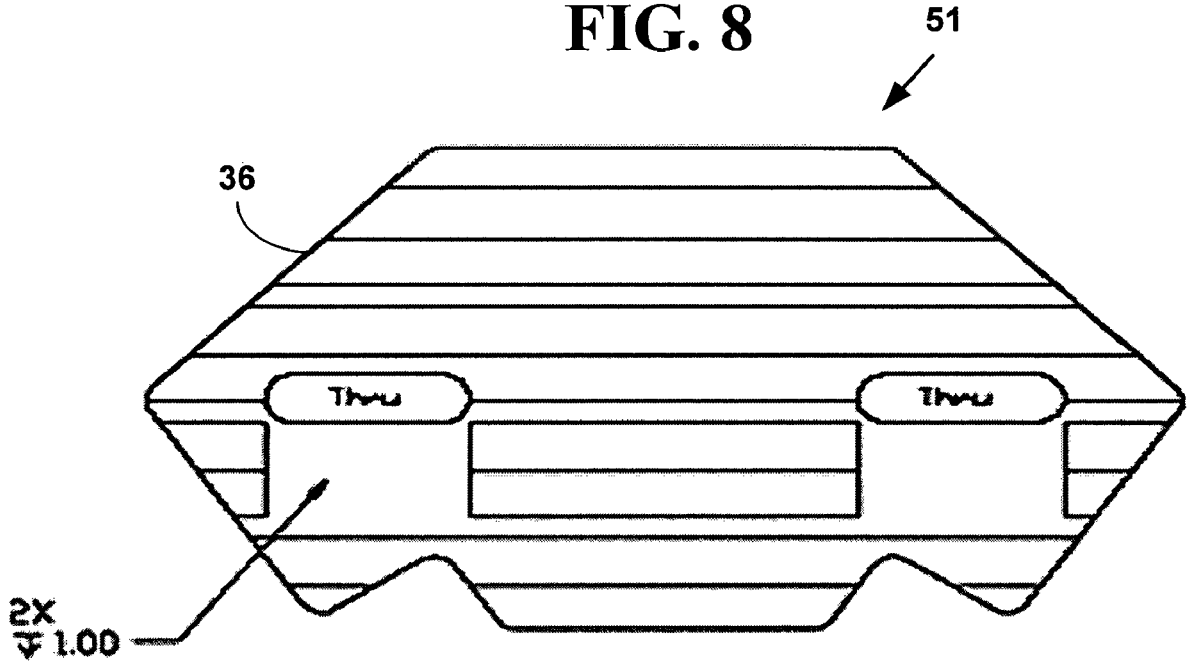
FIG. 8 is a block diagram illustrating a bottom view of the resistance kickboard with exemplary measurements and angles for one exemplary embodiment.

FIG. 8 is a block diagram illustrating a bottom perspective view 51 of the resistance kickboard with exemplary measurements and angles for one exemplary embodiment.

Figure 8B:
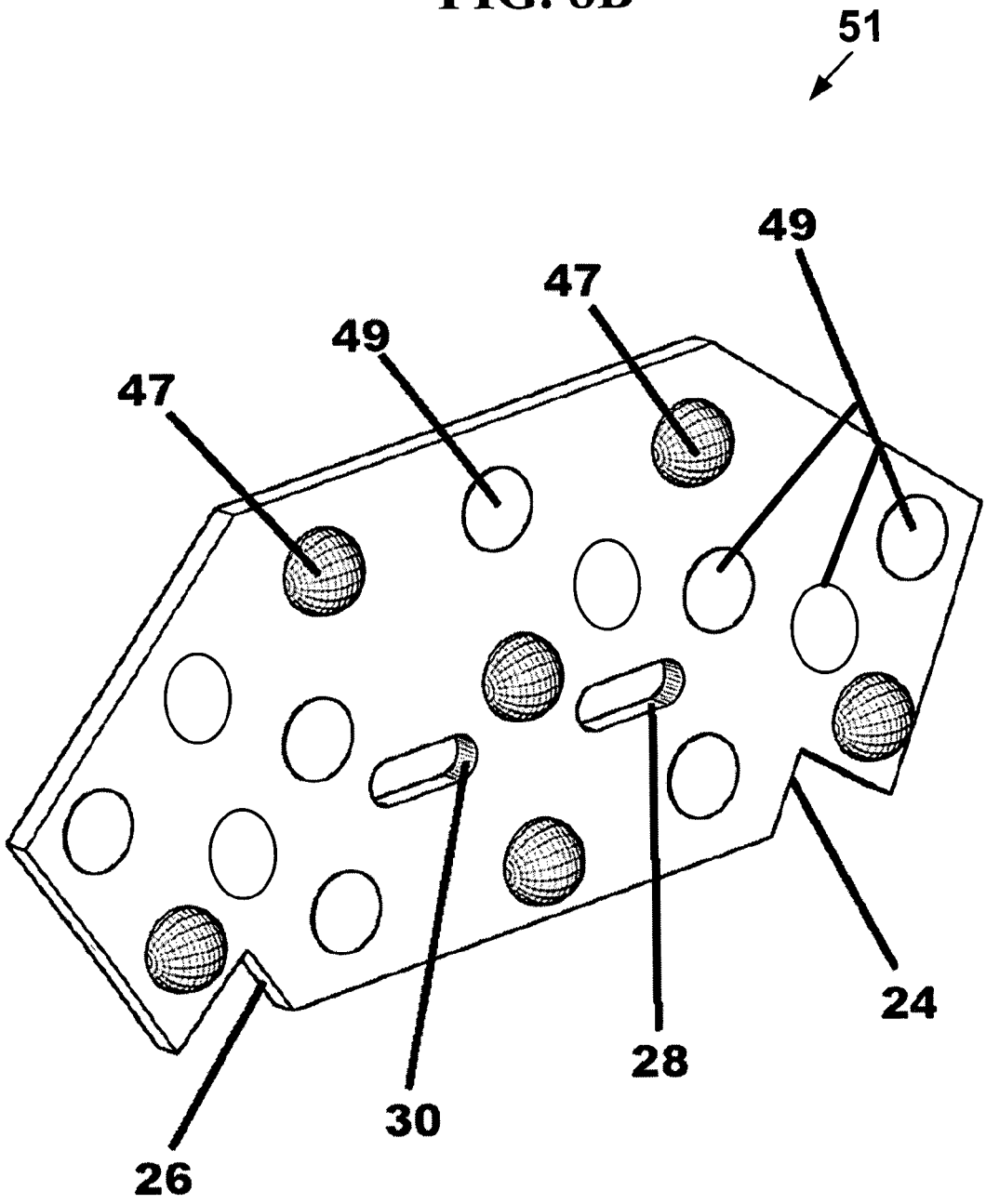
FIG. 8B is a block diagram illustrating a bottom perspective view of the resistance kickboard.

FIG. 8B is a block diagram illustrating a bottom perspective view 51 of the resistance kickboard. The plural non-equally spaced resistance indicia include non-angular (e.g., rounded or other) resistance indicia 47. FIG. 8B also illustrates plural attachment receptacles 49 in various locations on the bottom non-smooth side 34 of the rigid buoyant body 12 to provide adjustable varying levels of resistance and non-equally spaced resistance indicia. The plural attachment portions (e.g., pegs, etc.) 42 (FIG. 3) are engaged into the plural attachment receptacles 49 by selecting non-equally spaced sets of plural attachment receptacles 49.

FIGS. 6, 7 and 8 illustrate exemplary measurements (e.g. in inches) and angles for one exemplary embodiment. These measurements and angles are exemplary only for one specific embodiment. However, the present invention is not limited to these measurements and angles and other measurements and angles can be used to practice the invention.

Swimmers, exercisers and rehab patients currently have to stop from time to time to drink water to stay hydrated. This disrupts swimming training, exercising and rehab activities. Runners and athletes in other sports drink while exercising.

Figure 9:
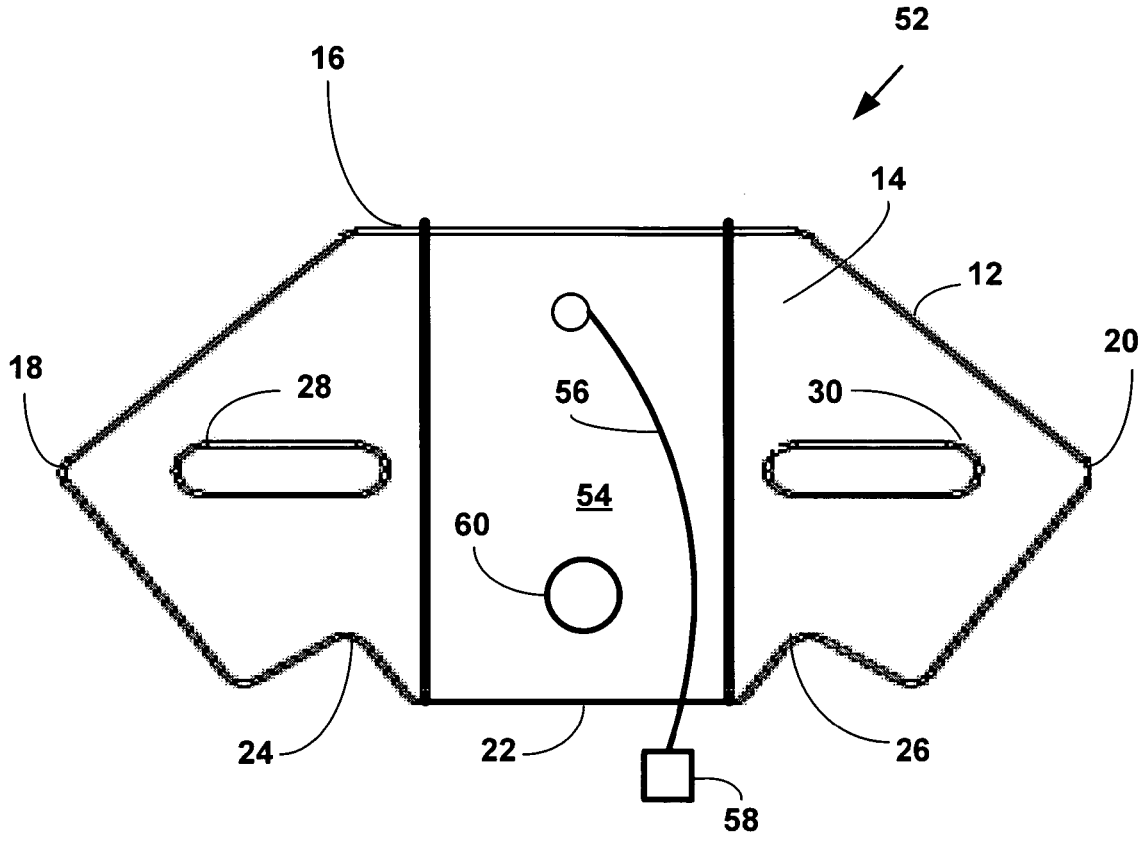
FIG. 9 is a block diagram illustrating a top view of the resistance kickboard with a reservoir.

FIG. 9 is a block diagram illustrating a top view 52 of the resistance kickboard with a reservoir 54. In one embodiment, the reservoir 54 is attached to the top smooth side 14 on the rigid buoyant body 12 for holding a liquid. A flexible tube 56 is connected at one end to the reservoir 54. The flexible tube 56 includes a compressible mouthpiece 58 attached at another other end of the flexible tube 56 for releasing a liquid from the reservoir 54 through the flexible tube 56 when compressed. The reservoir 54 also includes a filing means 60 with a closing means (not illustrated).

In one embodiment, for example, the reservoir 54 may include a filing component 60 with a screw cap that allows the reservoir 54 to be filled with a hydrating liquid (e.g., water, electrolyte solution, soft drink, etc.). However, the invention is not limited to such an embodiment, another other embodiments may also be used to practice the invention.

In one embodiment, the compressible mouthpiece 58 is inserted into a user mouth. When liquid from the reservoir 54 is desired, the compressible mouthpiece 58 is compressed by the user (e.g., biting down on it, squeezing it, etc.) liquid is obtained from the reservoir 54 via the flexible tube 56. However, the present invention is not limited to this embodiment and other embodiment may also be used to practice the invention.

In one embodiment, the reservoir 54 is permanently attached to the rigid buoyant body. In another embodiment, the reservoir 54 is removable and attached to the rigid buoyant body 12 with one or more flexible bands including, but not limited to, elastic, rubber, plastic, composite materials, etc.

In one embodiment the reservoir 54 is attached to the top smooth side 14 on the rigid buoyant body 12 for holding a liquid. In such an embodiment, the reservoir 54 adds additional resistance to the resistance kickboard.

Figure 10:
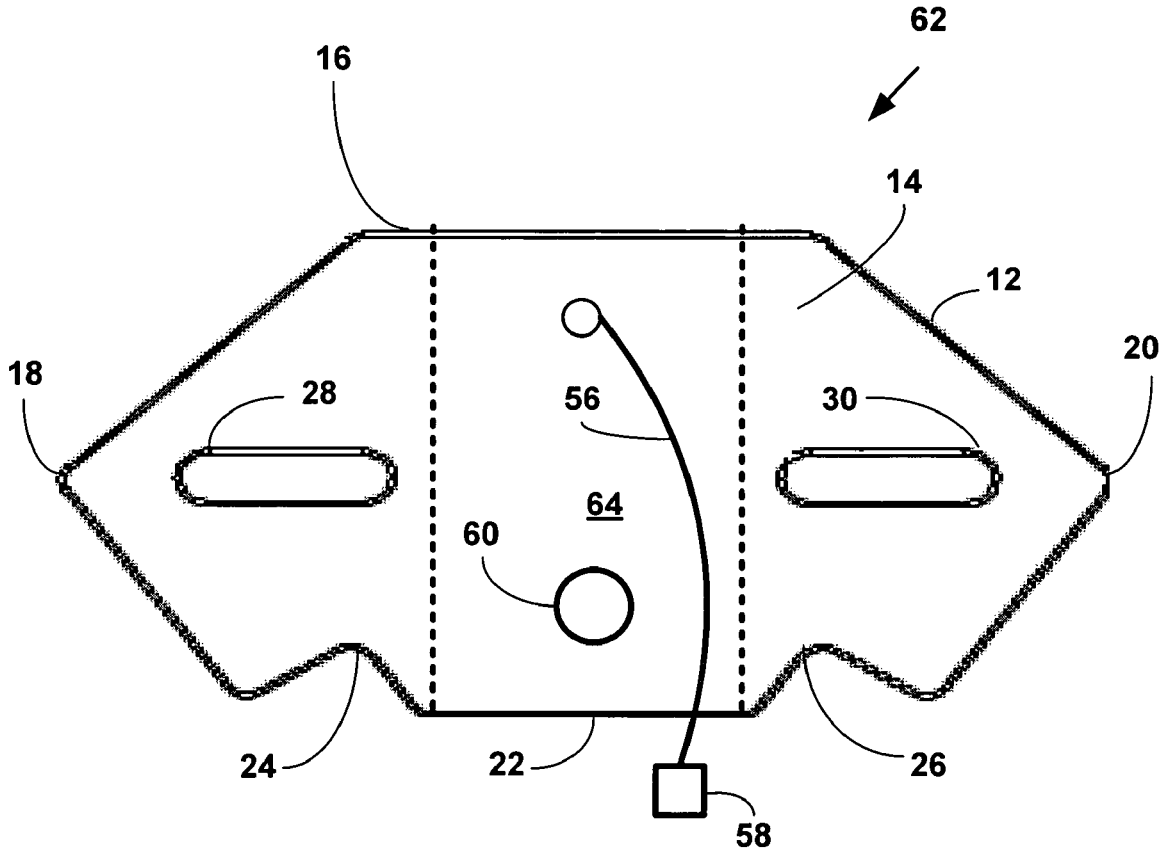
FIG. 10 is a block diagram illustrating a top view of the resistance kickboard with an integral reservoir.

FIG. 10 is a block diagram illustrating a top view 62 of the resistance kickboard with an integral reservoir 64. In such an embodiment, the reservoir 64 is integral to the resistance kickboard. That is, the resistance kickboard includes the reservoir 64 in a hollow portion of the rigid buoyant body 12. The hollow portion is illustrated as only a pre-determined portion of the rigid buoyant body 12. However, in another embodiment, the hollow portion may include an entire portion of the rigid buoyant body 12. In such an embodiment with an integral reservoir 64, only the flexible tube 56 extends from the top smooth side 14 and provides very minimal additional resistance to the resistance kickboard.

In embodiments with a reservoir 54, 60, the weight of the liquid will provide additional resistance to the user as the resistance kickboard is moved through the water. As the liquid is consumed, the resistance kickboard will become more buoyant and provide less resistance for the user. In such embodiments, the buoyancy of the resistance kickboard is adjusted to compensate for being filed with a liquid and for having the liquid consumed. Thus, the buoyancy of a resistance kickboard with a reservoir may be slightly different than a resistance kickboard without a reservoir.

It should be understood that the materials and components described herein are not related or limited to any particular type materials and components unless indicated otherwise. Various other types of materials and components may be used with or perform operations in accordance with the teachings described herein.

In view of the wide variety of embodiments to which the principles of the present invention can be applied, it should be understood that the illustrated embodiments are exemplary only, and should not be taken as limiting the scope of the present invention. For example, more or fewer elements may be used in the block diagrams.

The claims should not be read as limited to the described order or elements unless stated to that effect. In addition, use of the term "means" in any claim is intended to invoke 35 U.S.C. §112, paragraph 6, and any claim without the word "means" is not so intended.

Therefore, all embodiments that come within the scope and spirit of the following claims and equivalents thereto are claimed as the invention.

I claim:

1. A resistance kickboard, comprising:

a one piece rigid buoyant body;

a top smooth side on the rigid buoyant body;

a bottom side on the one piece rigid buoyant body with a plurality of resistance components formed at a pre-determined angle and existing as a portion of the bottom side that provide resistance when the one piece rigid buoyant body is moved through water, wherein the plurality of resistance components include a plurality of equally spaced parallel rows of angular components formed on the bottom side of the one piece rigid buoyant body, wherein selected ones of the plurality of equally spaced parallel rows of angular components extend completely across the bottom side from one side to another side and are parallel to each other, wherein the pre-determined angle includes a pre-determined angle between forty-five degrees and one-hundred thirty-five degrees, wherein each angular component in the plurality of equally spaced parallel rows of angular components includes a plurality of individual resistance elements to individually provide resistance in the water, wherein the plurality of equally spaced parallel rows of angular components collectively provide resistance in the water; and wherein varying the pre-determined angle of the plurality of resistance components formed and existing as a portion of the bottom side provides varying levels of resistance in the water; and a plurality of grasping locations on the one piece rigid buoyant body.

2. The resistance kickboard of claim 1 wherein the rigid buoyant body comprises Ethylene Vinyl Acetate (EVA) foam or closed cell EVA foam.

3. The resistance kickboard of claim 1 wherein the rigid buoyant body includes a pre-determined width of at least two times a pre-determined length.

4. The resistance kickboard of claim 1 wherein the rigid buoyant body includes a front straight side, an angular left side, an angular right side and an angular back side, the angular back side including a plurality of grasping locations.

5. The resistance kickboard of claim 1 wherein the rigid buoyant body includes one of a plurality of different pre-selected colors, wherein a selected color from the plurality of different pre-selected colors indicates a resistance level for the plurality of resistance components that provide a selected resistance when the rigid buoyant body is moved through water.

6. The resistance kickboard of claim 1 wherein the plurality of grasping locations include a plurality of angular notches on an edge of the rigid buoyant body.

7. The resistance kickboard of claim 1 wherein the plurality of grasping locations including a plurality of contoured locations having openings therein extending through the top smooth side and bottom side of the rigid buoyant body.

8. The resistance kickboard of claim 1 further comprising a reservoir attached to the top smooth side on the rigid buoyant body for holding a liquid and a flexible tube connected at one end to the reservoir and including a compressible mouthpiece attached at another end of the flexible tube for releasing a liquid from the reservoir through the flexible tube when pressure is applied to the compressible mouthpiece.

9. The resistance kickboard of claim 1 further comprising a reservoir included in a hollow portion of the rigid buoyant body for holding a liquid and a flexible tube connected at one end to the reservoir and including a compressible mouthpiece attached at another end of the flexible tube for releasing a liquid from the reservoir through the flexible tube when pressure is applied to the compressible mouthpiece.

10. A resistance kickboard, comprising:

a rigid buoyant body with a plurality of removable resistance components;

a top smooth side on the rigid buoyant body;

a bottom side on the rigid buoyant body for attaching the plurality of removable resistance components, wherein attaching the plurality of resistance components forms a pre-determined angle with the bottom side that provides resistance when the rigid buoyant body is moved through water, wherein the plurality of removable resistance components are attached in a plurality of equally spaced parallel rows, wherein selected ones of the plurality of removable resistance components extend completely across the bottom side from one side to another side and are parallel to each other, wherein the pre-determined angle includes a pre-determined angle between forty-five degrees and one-hundred thirty-five degrees, wherein each of the plurality of removable resistance components includes a plurality of individual resistance elements to individually provide resistance in the water, wherein the plurality of removable resistance components attached in the plurality of equally spaced rows collectively provide resistance in the water, and wherein varying the pre-determined angle of the plurality of removable resistance components provides varying levels of resistance in the water; and a plurality of grasping locations on the rigid buoyant body.

11. A resistance kickboard, comprising:

a one piece rigid buoyant body;

a top smooth side on the one piece rigid buoyant body;

a bottom side on the one piece rigid buoyant body with a plurality of resistance components formed at a pre-determined angle and existing as a portion of the bottom side that provide resistance when the rigid buoyant body is moved through water, wherein the plurality of resistance components include a plurality of equally spaced parallel rows of angular components formed on the bottom side of the one piece rigid buoyant body, wherein selected ones of the plurality of equally spaced parallel rows of angular components extend completely across the bottom side from one side to another side and are parallel to each other, wherein the pre-determined angle includes a pre-determined angle between forty-five degrees and one-hundred thirty-five degrees, wherein each angular component in the plurality of equally spaced parallel rows of angular components includes a plurality of individual resistance elements to individually provide resistance in the water, wherein the plurality of equally spaced parallel rows of angular components collectively provide resistance in the water and wherein varying the pre-determined angle of the plurality of resistance components formed and existing as a portion of the bottom side provides varying levels of resistance in the water;

a reservoir attached to the top smooth side on the one piece rigid buoyant body or included in a hollow portion of the one piece rigid buoyant body for holding a liquid; and a flexible tube connected at one end to the reservoir and including a compressible mouthpiece attached at another end of the flexible tube for releasing a liquid from the reservoir through the flexible tube when pressure is applied to the compressible mouthpiece.

12. A resistance kickboard, comprising:

a buoyancy means for providing buoyancy support for an aquatic activity;

a plurality of detachable resistance means selectively attachable to and selectively removable from a bottom surface of the buoyancy means each with a plurality of angular resistance components for providing resistance when the buoyant means is moved through water, wherein the plurality of angular resistance components include a plurality of parallel rows of equally spaced angular resistance components selectively attachable to and selectively removable from the bottom surface of the buoyancy means at a pre-determined angle, wherein selected ones of the plurality of rows of equally spaced angular resistance components extend completely across the bottom surface from one side to another side and are parallel to each other, wherein each angular resistance component the plurality of rows of equally spaced angular resistance components includes a plurality of individual resistance elements to individually provide resistance in the water, wherein the plurality of rows of equally spaced angular resistance components collectively provide resistance in the water, wherein the pre-determined angle includes a pre-determined angle between forty-five degrees and one-hundred thirty-five degrees and wherein varying the angle of the plurality of rows of equally spaced angular resistance components provides varying levels of resistance in the water and wherein different individual angular resistance components with different pre-determined angles can be selectively attached at the same time in varying orders to the bottom surface to provide varying levels of resistance; and a plurality of grasping means for grasping the buoyancy means.

13. The resistance kickboard of claim 12 further comprising: a reservoir means attached to, or included as a hollow portion of the buoyancy means for holding a liquid, wherein the reservoir means includes a liquid transfer means connected at one end to the reservoir means and including a pressure activated releasing means attached to another end of the liquid transfer means for releasing a liquid from the reservoir means through the liquid transfer means when pressure is applied to the pressure activated releasing means.

14. The resistance kickboard of claim 12 wherein a plurality of detachable resistance means include a plurality of detachable resistance means with a plurality of angular resistance components with a plurality of different angles.

15. A resistance kickboard, comprising:

a one piece buoyancy means for providing buoyancy support for an aquatic activity with a resistance means formed on and existing as a portion of a bottom surface of the buoyancy means;

the resistance means on the bottom surface of the buoyancy means with a plurality of angular resistance components formed at a pre-determined angle and existing as a portion of the bottom surface of the resistance means for providing resistance when the one piece buoyancy means is moved through water, wherein the plurality of angular resistance components include a plurality of parallel rows of equal spaced angular resistance components formed into the bottom surface of the one piece buoyancy means, wherein selected ones of the plurality of parallel rows of equally spaced angular resistance components extend completely across the bottom surface from one side to another side and are parallel to each other, wherein each angular resistance component the plurality of parallel rows of equally spaced angular resistance components includes a plurality of individual resistance elements to individually provide resistance in the water, wherein the plurality of parallel rows of equally spaced angular resistance components collectively provide resistance in the water, wherein the pre-determined angle includes a pre-determined angle between forty-five degrees and one-hundred thirty-five degrees and wherein varying the pre-determined angle of the plurality of angular resistance components formed and existing as a portion of the bottom surface provides varying levels of resistance in the water;

a plurality of grasping means for grasping the one piece buoyancy means; and a reservoir means attached to, or included as a hollow portion of the one piece buoyancy means for holding a liquid, wherein the reservoir means includes a liquid transfer means connected at one end to the reservoir means and including a pressure activated releasing means attached to another end of the liquid transfer means for releasing a liquid from the reservoir means through the liquid transfer means when pressure is applied to the pressure activated releasing means.

16. The resistance kickboard of claim 15 wherein the buoyancy means includes one of a plurality of different pre-selected colors, wherein a selected color from the plurality of pre-selected colors indicates a resistance level for the plurality of resistance components that provide a selected resistance level when the buoyancy means is moved through water.

* * * * *